US006625978B1

(12) United States Patent
Eriksson et al.

(10) Patent No.: US 6,625,978 B1
(45) Date of Patent: Sep. 30, 2003

(54) FILTER FOR EGR SYSTEM HEATED BY AN ENCLOSING CATALYST

(76) Inventors: Ingemar Eriksson, Garnvägen 15, Kvissleby (SE), 862 91; Micael Blomquist, BlÅklintsvägen 3, Kvissleby (SE), 862 34

( * ) Notice: Subject to any disclaimer, the term of this patent is extended or adjusted under 35 U.S.C. 154(b) by 0 days.

(21) Appl. No.: 09/857,568

(22) PCT Filed: Dec. 7, 1999

(86) PCT No.: PCT/SE99/02275

§ 371 (c)(1),
(2), (4) Date: Jun. 7, 2001

(87) PCT Pub. No.: WO00/34630

PCT Pub. Date: Jun. 15, 2000

(30) Foreign Application Priority Data

Dec. 7, 1998 (SE) ..... 9804028

(51) Int. Cl.[7] ..... F01N 03/02

(52) U.S. Cl. ..... 60/311; 60/278; 60/295; 60/280; 60/300

(58) Field of Search ..... 60/278, 280, 295, 60/311, 299, 300, 303; 55/DIG. 30

(56) References Cited

U.S. PATENT DOCUMENTS 4,380,900 A * 4/1983 Linder et al. ..... 55/DIG. 30
4,535,588 A 8/1985 Sato et al.
4,538,411 A * 9/1985 Wade et al. ..... 60/605.2
4,553,387 A * 11/1985 Mayer ..... 60/311
5,067,319 A 11/1991 Moser
5,207,734 A 5/1993 Day et al.
5,307,627 A * 5/1994 Christensen et al. ..... 60/311
5,927,075 A * 7/1999 Khair ..... 60/605.2
6,058,698 A * 5/2000 Coral et al. ..... 60/311

FOREIGN PATENT DOCUMENTS

EP 789135 8/1997
JP 8338320 12/1996

OTHER PUBLICATIONS

Patent Abstracts of Japan, vol. 7, No. 165, M–230, Abstract of JP58–72609A, Apr. 30, 1983.

* cited by examiner

*Primary Examiner*—Thomas Denion
*Assistant Examiner*—Diem Tran
(74) *Attorney, Agent, or Firm*—Dilworth & Barrese LLP

(57) ABSTRACT

A device and a method for exhaust gas purification in a combustion engine comprises an arrangement (30) for recirculating exhaust gases from the engine (1) to an air intake (2) thereof. An exhaust gas purification arrangement (31) is adapted to convert constituents in the exhaust gases to less environmentally hazardous substances. A filter arrangement (32) comprises at least one filter (33) adapted to liberate the exhaust gases from particulate constituents. This filter (33) is adapted to purify EGR-exhaust gases only. According to another aspect of the invention, 2 the filter (33) is aged in heat transferring relation to at least one convener unit (34) of the exhaust gas purification arrangement so as to receive, from the convener unit, a heat addition to promote regeneration of the filter by combustion of paniculate constituents deposited therein.

32 Claims, 3 Drawing Sheets

FILTER FOR EGR SYSTEM HEATED BY AN ENCLOSING CATALYST

FIELD OF THE INVENTION AND PRIOR ART

This invention is related to a device for purifying exhaust gases from a combustion engine according to the precharacterizing part of enclosed claim 1. Besides, the invention is related to a method for exhaust gas purification and use of the device for exhaust gas purification in particular at a diesel engine.

It is known that EGR (Exhaust Gas Recirculation) is an advantageous purification method for reducing the proportion of hazardous exhaust gases, in particular nitrogen oxide ($NO_x$). In an EGR-system, a part of the exhaust gases from the engine are recirculated to an air intake thereof.

It is also known to use exhaust gas purification arrangements comprising at least one converter unit for converting constituents of the exhaust gases to less environmentally hazardous substances. According to the present state of the art, such converter units comprise, generally, catalysts for achieving a catalytic conversion of constituents in the exhaust gases to less environmentally hazardous substances. Thus, by means of such catalysts, carbon monoxide and hydro carbons may be converted to carbon dioxide and water. This presupposes that the exhaust gases contain a certain amount of oxygen. For this purpose an oxygen measuring unit is generally used in the exhaust gas flow from the engine and this unit delivers output signals, on basis of which the operation of the engine is controlled to achieve the required oxygen contents. Furthermore, also nitrogen oxides may be converted to neutral nitrogen by means of such catalysts. An excess of oxygen in the exhaust gases would give rise to cessation of the reduction of nitrogen oxides whereas a deficiency with respect to oxygen would counteract conversion of the other constituents mentioned above in the exhaust gases. An optimal regulation of the fuel system may, however, cause a decrease of all above mentioned, hazardous constituents. By using EGR technique, a further reduction of nitrogen oxides may be achieved.

In addition, there exists the problem, in particular in diesel engines, that they generate a substantial amount of particulate constituents. Within the framework of the expression particulate constituents there are included both particles as such, for instance soot, and organic residues (denominated SOF) which emanate from fuel and oil. It is known to use filters of various types to liberate the exhaust gases from such particulate constituents. It is also known to design such filters as regenerating, i.e. that they may be restored without exchange. Such regeneration is according to the prior art achieved by heating the filters to a required degree so that combustion of the particulate constituents occurs. The energy requirement for such combustion is very large, for what reason one has had, according to the prior art, to immobilise the filter, either still coupled to the engine or removed therefrom so that by connection of a heating element to an electric power network the required heating may occur. Thus, this necessitates an, interruption of operation. Another technique (U.S. Pat. No. 5,207,734 and JP 8338320) to achieve regeneration of a filter in an EGR recirculation conduit is to use a catalyst upstreams of the filter to provide for a heat addition to the filter from the catalyst. However, this results in deficient filter regeneration, in particular when the recirculated exhaust gas amount is small as it is under some engine operating conditions.

SUMMARY OF THE INVENTION

The object of the present invention is to develop the prior art for the purpose of achieving efficient filter regeneration and efficient purification with regard to $NO_x$, carbon monoxide, hydro carbons, particles etc.

This object is achieved by the features of enclosed claim 1.

The present invention is, accordingly, based upon the idea to arrange the filter so that heat in the exhaust gases and in addition the heat which occurs as a consequence of the conversion in the converter unit may be transversely transported from the converter unit to the filter so that the conditions for regeneration of the filter are substantially improved. It is pointed out that in EGR systems, the recirculated exhaust gas volume varies depending upon the operational conditions of the engine. During some conditions small volumes per time unit pass the filter. The heating requirement of the filter for regeneration may then not be satisfied by the heat in the exhaust gases flowing through the filter only. According to the invention it is possible to reach such high temperatures of the filter that only a comparatively small heat addition, if any, is required in order to achieve, also under difficult operational conditions, the necessary filter regeneration, i.e. combustion of particulate constituents deposited in and on the filter. More specifically, conditions are in this way created to bring the filter to the necessary regeneration temperatures by means of one or more heating elements having a relatively low effect. The energy supply to such heating elements does not become higher than making electric systems provided on e.g. vehicles capable of producing the energy generation.

Further preferable embodiments of the invention are dealt with in the rest of the claims and in the following description.

The method according to the invention and use of the device are recited in the enclosed claims.

BRIEF DESCRIPTION OF THE DRAWINGS

With reference to the enclosed drawings, a more specific description of embodiment examples of the invention will follow hereafter.

In the drawings.

DETAILED DESCRIPTION OF PREFERRED EMBODIMENTS

Figure 1:
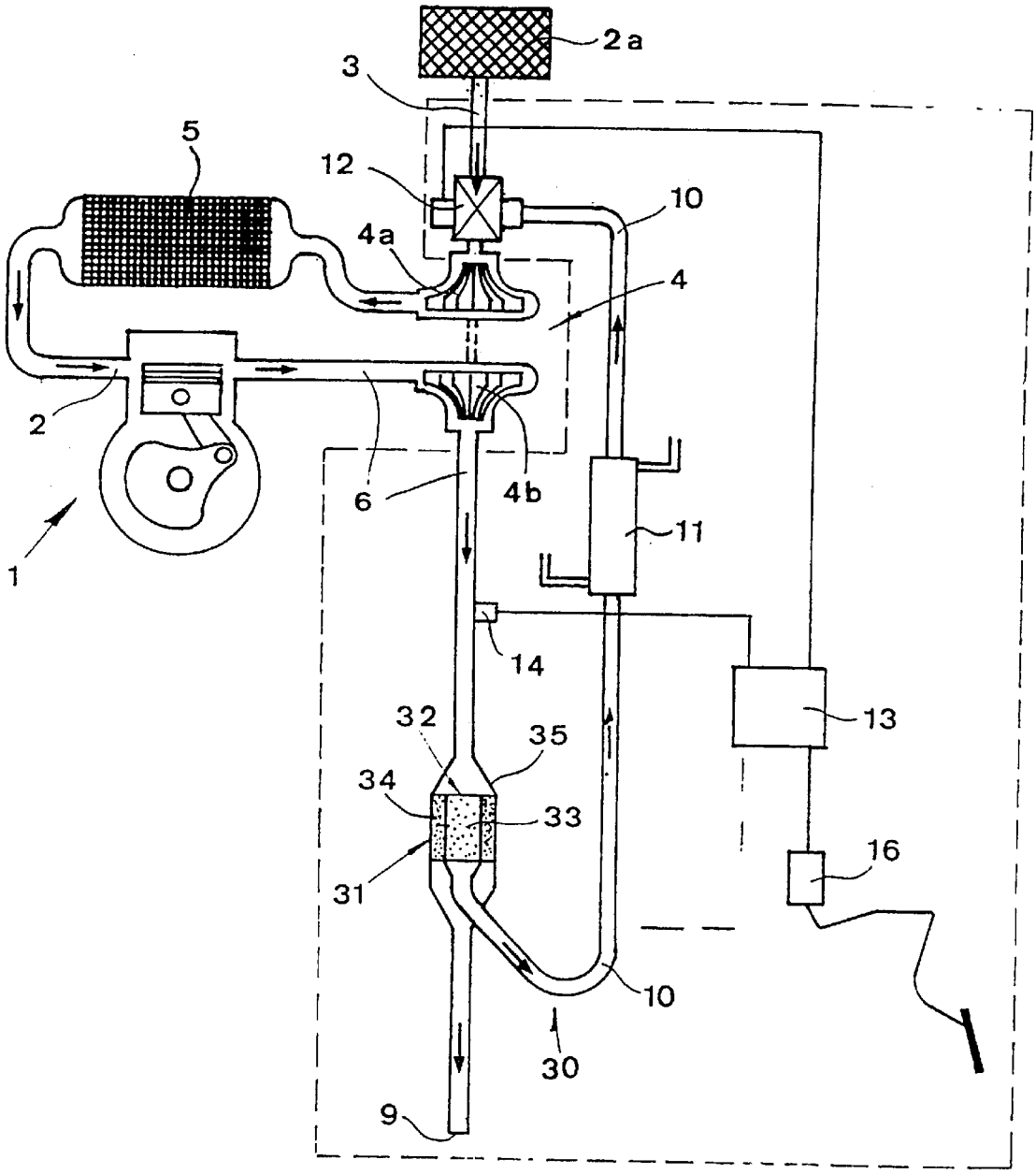
FIG. 1 is a principle drawing showing an engine installation with exhaust gas purification according to the invention.

FIG. 1 illustrates diagrammatically the device according to the invention in the form of an engine installation and exhaust gas purification applied thereto. The combustion engine is diagrammatically indicated at 1. Air is taken thereto via an air intake 2, in connection with which an air filter 2*a* may be provided. The air is directed via an inlet air channel generally denoted 3 towards combustion chambers of the engine. It is already now pointed out that the present invention is applicable to engines operating by suction only, i.e. where the air transport into the combustion chamber of the engine is generated by suction due to piston movements in the engine. However, the invention is also applicable to supercharging, i.e. forced air supply to the engine, which generally can be accomplished by means of a compressor. Such a compressor may be driven in an arbitrary manner, e.g. mechanically via the engine or suitable auxiliary equipment or, as indicated in FIG. 1, by means of the exhaust gas flow from the engine. Thus, the device comprises in the example a turbo charger 4, comprising a compressor wheel 4*a* for feeding the air to the engine with over-pressure and a turbine wheel 4*b* placed so as to be put into rotation by actuation of exhaust gases leaving the engine. The compressor wheel 4*a* and the turbine wheel 4*b* are operationally coupled to each other, e.g. by being placed on one and the same axle. As is usual in supercharging, the air may be subjected to cooling, after having been imparted an over-pressure, in a charging air cooler 5 (intercooler). The exhaust gases exiting the engine move in an exhaust pipe 6 and enter into the surroundings via an exhaust gas outlet 9.

As will be described in more detail in the following, the device comprises an arrangement generally denoted 30 for recirculating exhaust gases from the engine to the air intake 2 of the engine. For this purpose there is a recirculation conduit denoted 10. This is in the example connected to the inlet air channel denoted 3. If required, the recirculation conduit 10 may pass through a cooler 11 to cool down the recirculated exhaust gases. The conduit 10 may adjoin to the inlet air channel 3 via a valve arrangement 12, which is controllable by means of an EGR control arrangement 13. The valve arrangement 12 may, by means of the EGR control arrangement 13, regulate the relation between the amount of supplied fresh air from the inlet air channel 3 and the supplied amount of recirculated exhaust gases from the recirculation conduit 10. This mixture adjusted by means of the valve 12 may, accordingly, be supplied to the air intake 2 of the engine.

The EGR control arrangement 13, which controls the valve device 12, is supplied with information about the actual state of operation of the engine from a.o. an oxygen measuring probe (lambda probe) 14, a sensor 15 for the number of revolutions of the engine and a sensor 16 for throttle position. The EGR control arrangement 13 is programmed to control the valve device 12 and, accordingly, the mixing relation fresh air/exhaust gases for the purpose of minimising the contents of hazardous substances leaving the exhaust gas outlet 9 and being released into the free air. The programming of the EGR control arrangement 13 occurs in a manner known perse to achieve a favourable relation between the various factors mentioned above.

The valve arrangement 12 could of course comprise separate valves in the inlet air channel 3 and in the recirculation channel 10, said valves then being separately controllable by the EGR control arrangement 13. Alternatively, the valve arrangement 12 may also comprise a unit, in which flows from the inlet air channel 3 and the recirculation conduit 10 may be selectively brought together, by means of valves included in the valve arrangement, to a common output flow, which is directed further towards the air intake 2 of the engine.

The device according to the invention-further comprises an exhaust gas purification arrangement generally denoted 31 and adapted to convert constituents in the exhaust gases to less hazardous substances. Furthermore, the device comprises a filter arrangement generally denoted 32 and adapted to liberate the exhaust gases from particulate constituents.

The filter arrangement 32 comprises at least one filter 33 arranged in heat transferring relation to at least one converter unit 34 of the exhaust gas purification arrangement 31 for receiving, from the converter unit, a heat addition for promoting regeneration of the filter 33 by combustion of particulate constituents deposited therein.

It appears diagrammatically from FIG. 1 that both the exhaust gas purification arrangement 31 and the filter arrangement 32 are conceived to be placed in a common casing 35 located in such a way in the exhaust pipe 6 that the casing in a manner described hereinafter will have a flow through the same of exhaust gases leaving the engine.

Figure 2:
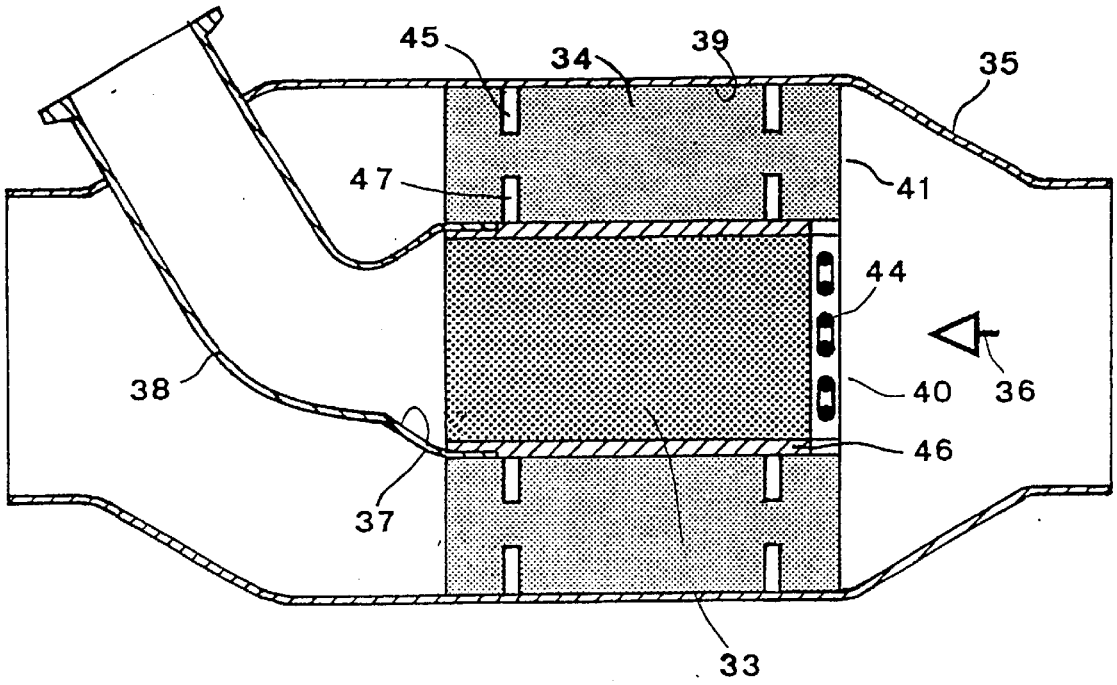
FIG. 2 is a partly cut view illustrating the arrangement according to the invention of a converter unit and a filter.
Figure 3:
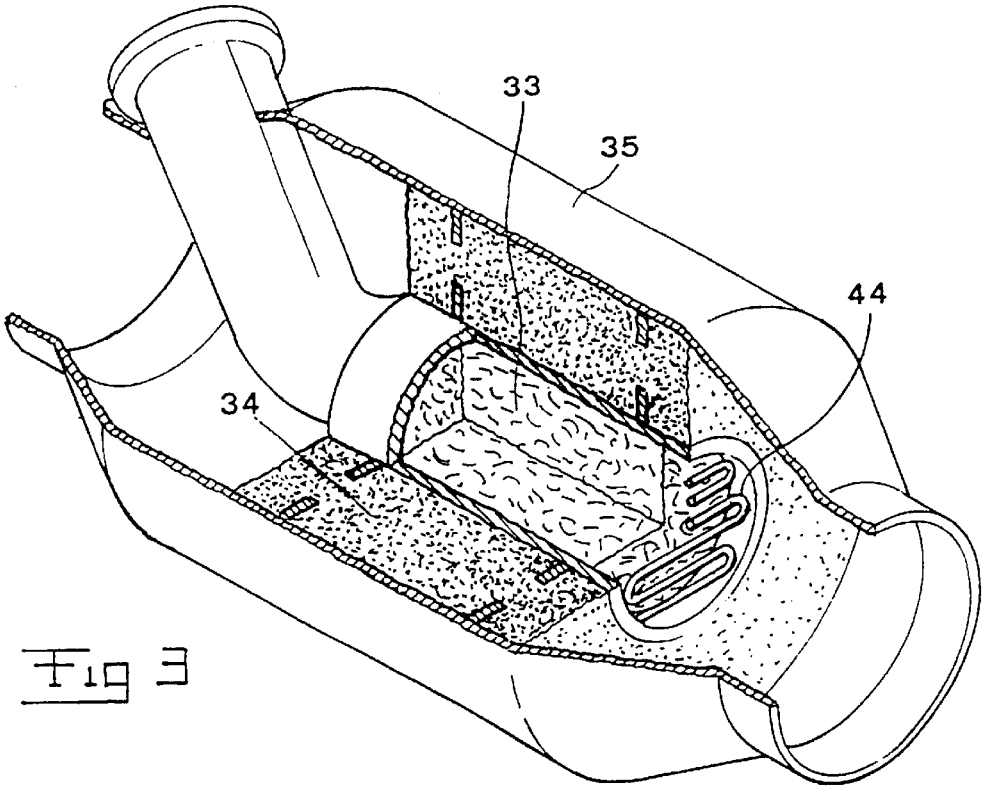
FIG. 3 is a perspective view of that which appears in longitudinal section in FIG. 2.

FIGS. 2 and 3 illustrate in a larger scale the casing 35 appearing from FIG. 1 and the components present therein. The intended flow direction of exhaust gases is indicated with the arrow 36 in FIG. 2. Thus, the exhaust gases from the engine arrive at the right side in both FIGS. 2 and 3.

The filter 33 is arranged in a first flow path 37 adapted to recirculate exhaust gases to the air intake 2 of the engine. More specifically, this flow path 37 comprises a pipe piece 38 included in the recirculation conduit 10 previously mentioned. The pipe piece 38 is illustrated, in the example, as being bent and directed obliquely out through the casing 35.

The converter unit 34 is arranged in a second flow path 39, in which exhaust gases flow from the engine to the exhaust gas outlet 9 (FIG. 1) communicating with the surroundings. The first and second flow paths 37, 39 are adapted to receive and have flowing through the same different exhaust gas flows received from the engine (arrow 36). Expressed in other words, the flow paths 37, 39 may be said to be arranged transversely overlapping and in parallel. In the example according to FIGS. 2 and 3, mouths 40 and 41 of the first and second flow paths 37 and 39 respectively are arranged so as to face arriving exhaust gases.

Figure 4:
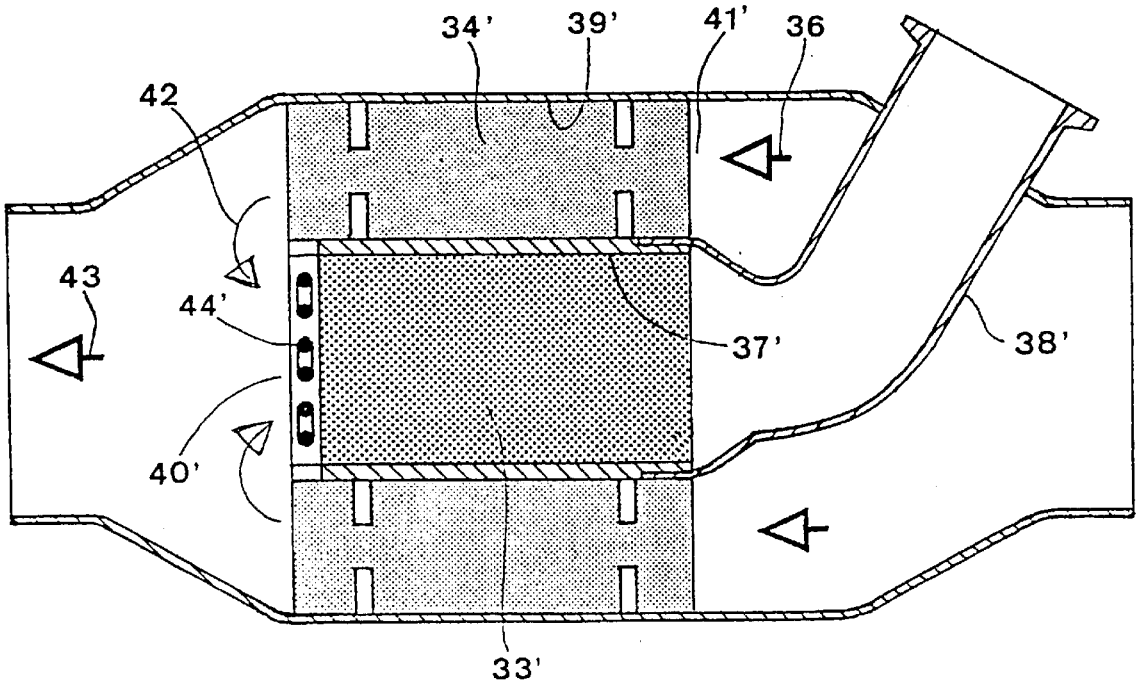
FIG. 4 is a view similar to FIG. 2 and illustrating the principle of an alternative embodiment of the invention.

FIG. 4 illustrates a variant in this regard. Here it is indicated with the arrows 36 how exhaust gases arrive from the engine. These exhaust gases first flow through the second flow path 39'. A part of the exhaust gases having passed the converter unit 34' then moves into the first flow path 37' according to the arrows 42. The main part of the exhaust gas flow proceeds in accordance with the arrow 43 towards the exhaust gas outlet 9. As in the preceding case, the pipe piece 38' is coupled to the recirculation conduit 10 according to FIG. 1. In summary, the converter unit 34' will have flowing through the same, in the variant according to FIG. 4, the entire exhaust gas flow whereas then a part of this exhaust gas flow will pass through the filter 33'.

Common to the embodiments according to FIGS. 2–4 is that the filter 33 is at least partly enclosed by the converter unit 34. More specifically, the embodiment is such in the example that the converter unit 34 is cross-sectionally substantially ring shaped whereas the filter 33 is arranged within this ring. In the example the converter unit has a substantially hole-cylindrical shape whereas the filter 33 is cylindrical.

In the embodiment according to FIG. 4, the mouth 40' of the first flow path 37' is located downstreams the converter unit 34' present in the second flow path 39' in contrast to the embodiment according to FIGS. 2 and 3, where the filter 33 and the converter unit 34 are parallel and transversely overlappingly arranged so that the mouths 40, 41 of their flow paths are situated generally in the same plane.

A heating element 44 is adapted to supply additional heat to the exhaust gases passing through the filter 33. The heating element 44 is adapted to heat only those exhaust gases being recirculated to the engine. Thus, the heating element 44 is arranged in the first flow path 37 upstreams of at least a part of the filter. More specifically, the heating element 44 is suitably arranged at the mouth 40 of the flow part 37. Corresponding comments are also applicable with regard to the embodiment according to FIG. 4 although, as appears from the preceding description, the heating element 44' will be located at that end of the converter unit 34' which is located downstreams as concerns the total exhaust gas flow according to the arrows 36.

It is preferred that the heating element 40 is electric. The operation of the heating element is preferably controlled by a control unit obtaining temperature information as to temperatures of the exhaust gases flowing in the recirculation conduit 10 back to the air intake of the engine so that accordingly the heating element may be caused to operate for achieving the desired temperature in the filter 33 proper. Instead of sensing the temperature in the recirculation conduit 10, a temperature sensor could of course also be integrated into the filter 33 proper or placed in the vicinity thereof.

The converter unit 34 comprises suitably a catalyst. This term refers to such a structure having a catalytical action such that exhaust gases flowing by may be converted catalytically so as to cause transfer of constituents in the exhaust gases to less environmentally hazardous substances. This gives rise to at least some heat addition in the converter unit 34. It is the heat of the exhaust gases and this heat addition that are intended to be, at least partially, communicated to the filter 33 in heat transferring relation to the converter unit 34.

As to the catalyst structure 34, it is pointed out that the same, thus, is formed by an oxidation catalyst, the ability of liberating the exhaust gases from particulate constituents being lower than that of a true filter but nevertheless important, e.g. in the order of 30–40% depending upon the nature of the particulate constituents. The catalyst structure 34 is normally prepared such that a suitable large-surface base material is coated with the true catalyst material, e.g. a precious metal.

The catalyst structure 34 may be secured relative to the casing 35 by means of suitable mechanical connection members 45.

The filter 33 comprises a material resistant to high temperatures and having a good filtrating ability. As an example ceramic materials, mineral fibres and metallic fibres may be mentioned as useful. The selected material must withstand the high temperatures that may arise on regeneration of the filter. It is preferred that the filter 33 and the converter unit 34 are separated by a tubular element 46, at one end of which the heating element 44 is located and the other end of which is connected to the pipe piece 38. The tubular element 46 may be connected to the surrounding converter unit 34 by means of securing elements 47.The filter 33 and cenverter unit 34 should be interrelated such that efficient heat transfer between them may occur by heat conduction and/or radiation.

It is pointed out that it would be possible to have the filter 33 carry out a dual function. Thus, the filter material could be provided with catalytic material so that also a catalytic conversion of constituents in the exhaust gases would occur in the filter.

The embodiment according to FIGS. 2 and 3 operates in the following manner: when the engine 1 is running, exhaust gases arrive according to the arrow 36 to the interior of the casing 35. A part of the exhaust gases passes through the converter unit 34 and is catalytically converted therein at the same time as the unit is capable of removing at least a part of the particulate constituents accompanying the exhaust gases and these particulate constituents are combusted in the unit 34 so that a regeneration occurs also with regard to this "filtration effect" in the converter unit 34.

Another part of the exhaust gases arriving according to the arrow 36 reaches into the flow path 37 and passes therein through the filter 33 and is liberated from particulate constituents. This part flow of the exhaust gases is recirculated via the recirculation conduit 10 to the air intake of the engine so that an EGR function arises with accompanying favourable effects with regard to exhaust gas purification. The filter 33 is highly efficient for filtration purposes and is typically capable of removing more than 90% of the particulate constituents from the exhaust gases. These constituents are deposited on the filter material. The filter material will be heated as a consequence of the heat in the exhaust gases and the combustion process in the surrounding catalyst material so that the filter 33 achieves a favourably raised temperature than otherwise. This increased temperature is used for regeneration of the filter, i.e. combustion of the particulate constituents deposited therein. This combustion may be promoted, if required by the circumstances, by increasing, by means of the heating element 44, the temperature of the exhaust gases passing the heating element 44 and reaching into the filter 33. By a suitable temperature sensing, an optimum regulation of the temperature in the filter 33 may be achieved. It is in this connection pointed out that regeneration of the filter 33 may occur continuously as well as intermittently.

It is again pointed out that it is possible, at least in part, to provide the filter 33 with a catalysing aspect so that filter regeneration may be carried out at a lower temperature than that which otherwise would be necessary. However, it is pointed out that it is the filtrating effect of the element 33 which is of primary interest; the mentioned catalyst effect is only secondary.

The function is in all essentials the same in the embodiment described in FIG. 4 with the exception that there the exhaust gases having passed the converter unit 34' are those which also to a part will pass through the filter 33'.

It is emphasised that the invention described in no way is limited only to that which has been described above. Although the invention is particularly preferable with diesel engines, it is pointed out that the same also may be used with other engine types. Furthermore, it is pointed out that of course other arrangements of filters 33 and converter units 34 are possible to realise by the man skilled in the art when the basic concept of the present invention has been presented. Thus, a plurality of filter elements could of course be provided and these filter elements could be distributed in one or more bodies of the converter unit 34, i.e. that it is not necessary that the filter/converter unit 34 are concentric. The important thing for this aspect of the invention is that the filter 33 and the converter unit 34 are present in such mutual heat transferring connection that the filter 33 will be heated by the converter unit 34. As an example, the filter 33 could be arranged to enclose the converter unit 34 instead of the opposite. Also other modifications are possible within the scope of the invention.

What is claimed is:

1. A device for purifying exhaust gases from a combustion engine (1), comprising an arrangement (30) for recirculating exhaust gases from the engine to an air intake (2) thereof, an exhaust gas purification arrangement (31) adapted to convert constituents in the exhaust gases to less environmentally hazardous substances and a filter arrangement (32) adapted to liberate the exhaust gases from particulate constituents, the filter arrangement (32) comprising at least one filter (33)

arranged to receive from at least one converter unit (34) of the exhaust gas purification arrangement (31) a heat addition to promote regeneration of the filter by combustion of particulate constituents deposited therein, the filter (33) and the converter unit (34) being arranged in at least partly overlapping heat transferring relation as viewed transversely to the direction of exhaust gas flow, characterized in that the filter (33) is arranged in a first flow path (37) adapted to recirculate exhaust gases to the air intake (2) of the engine, and the converter unit (34) is arranged in a second flow path (39), in which exhaust gases flow from the engine (1) to an exhaust gas outlet (9) communicating with the surroundings.

2. A device according to claim 1, characterized in that the first and second flow paths (37, 39) are arranged to receive, from the engine, and have flowing through themselves separate exhaust gas flows.

3. A device according to claim 1, characterized in that the second flow path (39') is arranged to have flowing through the same at least one part exhaust gas amount, which thereafter flows through the first flow path (37').

4. A device according to claim 1, characterized in that one of the filter (33) and the converter unit (34) at least partly encloses the other of said filter and converter unit.

5. A device according to claim 4, characterized in that the filter (33) is at least partly enclosed by the converter unit (34).

6. A device according to claim 5, characterized in that the converter unit (34) is cross-sectionally substantially ring shaped and that the filter (33) is arranged with this ring.

7. A device according to claim 2, characterized in that mouths (40,41) of the first and second flow paths (37, 39) are arranged so as to face arriving exhaust gases.

8. A device according to claim 1, characterized in that the mouth (40') of the first flow path (37') is located downstream the converter unit (34') present in the second flow path (39').

9. A device according to claim 1, characterized in that the heating element (44) is adapted to supply additional heat to the exhaust gases passing through the filter (33).

10. A device according to claim 9, characterized in that the heating element (44') is adapted to heat only those exhaust gasses which are recirculated to the engine.

11. A device according to claim 9, characterized in that the heating element (44) is arranged in the first flow path (37) upstream of at least a part of the filter (33).

12. A device according to claim 9, characterized in that the heating element (44) is electric.

13. A device according to claim 9, characterized in that the converter unit (34) comprises a catalyst.

14. A device according to claim 1, characterized in that the filter (33) comprises a material resistant to high temperatures and having a good filtering capacity.

15. A device according to claim 1, characterized in that the first flow path (37) is connected to an exhaust pipe of the device either upstream or downstream of the converter unit (34) arranged in the exhaust pipe.

16. A device according to claim 1, characterized in that the first flow path (37) containing the filter (33) is connected to an exhaust pipe (6) of the device downstream of a turbo charger turbine placed in the exhaust gas stream.

17. Use of a device according to claim 1, for purification of exhaust gases from diesel engines.

18. A device according to claim 2, characterized in that the heating element (44) is adapted to supply additional heat to the exhaust gases passing through the filter (33).

19. A device according to claim 3, characterized in that the heating element (44) is adapted to supply additional heat to the exhaust gases passing through the filter (33).

20. A device according to claim 4, characterized in that the heating element (44) is adapted to supply additional heat to the exhaust gases passing through the filter (33).

21. A device according to claim 1, wherein said first flow path (37) containing said filter (33) and second flow path (39) containing said converter unit (34) are arranged in superimposed, overlapping relationship adjacent one another in said transverse direction to the direction of exhaust gas flow (36).

22. A device according to claim 21, wherein said first and second flow paths (37, 39) are arranged transversely overlapping and in parallel.

23. A device according to claim 1, wherein said first and second flow paths (37, 39) are separated from one another and form separate and distinct flow paths from one another.

24. A device according to claim 7, wherein said first flow path (37) containing said filter (33) is concentrically arranged within said second flow path (39) containing said converter unit (34), with said filter (33) and converter unit (34) being adjacent one another in said transverse direction to exhaust gas flow (36), a tubular element (46) separating said filter (33) and converter unit (34) from one another, with said mouths (40, 41) of said respective flow paths (37, 39) being generally situated in the same transverse plane, and said first flow path (37) communicating with said recirculating arrangement (30) through a bent pipe (38) directed obliquely out through a casing (35) comprising said filter (33) and converter unit (34), such that a portion of exhaust gases (36) entering an interior of said casing (35) pass through said converter unit (34) and are exhausted (9), while another portion of the exhaust gases (36) arriving into said container (35) pass into said first flow path (37), through said filter (33) and back to said combustion engine (1) along said recirculating arrangement (30).

25. A device according to claim 22, wherein said filter (33) is at least partially enclosed by said converting unit (34) with said filter (33) being substantially cylindrically shaped, and said converter unit (34) being substantially cross-sectionally ring shaped.

26. A device according to claim 23, wherein said mouth (40') of said first flow path (37') is located downstream of said converter unit (34') present in said second flow path

27. A device according to claim 1, additionally comprising a tubular element (46) separating said filter (33) and converter unit (34) in said transverse direction.

28. A device according to claim 1, wherein said filter (33) and converter unit (34) remain in continuous heat transferring relation as said exhaust gases simultaneously flow through both said first and second flow paths (37, 39).

29. A device according to claim 28, wherein said converter unit (34) is cross-sectionally substantially ring-shaped with said filter (33) arranged within this ring and being substantially cylindrical.

30. A device for purifying exhaust gases from a combustion engine (1),comprising an arrangement (30) for recirculating exhaust gases from the engine to an air intake (2) thereof, an exhaust gas purification arrangement (31) adapted to convert constituents in the exhaust gases to less environmentally hazardous substances and a filter arrangement (32) adapted to liberate the exhaust gases from particulate constituents, the filter arrangement (32) comprising at least one filter (33) arranged to receive from at least one converter unit

(34) of the exhaust gas purification arrangement (31) a heat addition to promote regeneration of the filter by combustion of particulate constituents deposited therein, the filter (33) and the converter unit (34) being arranged in at least partly overlapping heat transferring relation as viewed transversely to the direction of exhaust gas flow, characterized in that the filter (33) is arranged in a first flow path (37) adapted to recirculate exhaust gases to the air intake (2) of the engine, the converter unit (34) is arranged in a second flow path (39), in which exhaust gases flow from the engine (1) to an exhaust gas outlet (9) communicating with the surroundings, a mouth (40') of the first flow path (37') is located downstream of the converter unit (34') present in the second flow path (39'), said first flow path (37') containing said filter (33') comprises a mouth (40') opening in a direction facing away from incoming exhaust gas flow (36), with said first flow path (37') situated concentrically within said second flow path (39') comprising said converter unit (34') which is concentrically situated about said filter (33'), and said first flow path (37') communicates with said recirculating arrangement (30) through a bent pipe (38') directed obliquely out through a casing (35) containing said exhaust gas purification arrangement (31), such that exhaust gases (36) flowing from said combustion engine (1) entirely flow through said converter unit (34') situated in said second flow path (39'), with a portion of said exiting exhaust gas reversing direction (42) and flowing back into said first flow path (37') and through said filter (33').

31. A device for purifying exhaust gases from a combustion engine (1), comprising an arrangement (30) for recirculating exhaust gases from the engine to an air intake (2) thereof, an exhaust gas purification arrangement (31) adapted to convert constituents in the exhaust gases to less environmentally hazardous substances and a filter arrangement (32) adapted to liberate the exhaust gases from particulate constituents, the filter arrangement comprising at least one filter (33) arranged to receive from at least one converter unit (34) of the exhaust gas purification arrangement (31) a heat addition to promote regeneration of the filter by combustion of particulate constituents deposited therein, the filter (33) and the converter unit (34) being arranged in overlapping heat transferring relation as viewed transversely to the direction of exhaust gas flow, characterized in that the filter (33) is arranged in a first flow path (37) adapted to recirculate exhaust gases to the air intake (2) of the engine, the converter unit (34) is arranged in a second flow path (39), in which exhaust gases flow from the engine (1) to an exhaust gas outlet (9) communicating with the surroundings, and said filter (33) in said first flow path (37) back to the engine and said converter unit (34) in said second exhaust flow path (39) are arranged in complete superimposed overlapping relationship adjacent one another in said transverse direction to exhaust gas flow, with said filter (33) and converter unit (34) remaining in continuous heat transfer relation as said exhaust gases simultaneously flow through both said first and second flow paths (37, 39).

32. A device according to claim 31, wherein said converter unit (34) is cross-sectionally substantially ring-shaped with said filter (33) arranged within this ring and being substantially cylindrical.

* * * * *